US005953024A

United States Patent [19]

Lee et al.

[11] Patent Number: 5,953,024

[45] Date of Patent: Sep. 14, 1999

[54] APPARATUS AND METHOD FOR DETERMINING INITIAL POSITION AND PROTECTING CAPPING RELEASE ERROR IN INKJET PRINTER HEAD

[75] Inventors: Yong-duk Lee, Kyungki-do; Sang-won Cheong, Seoul; Jong-ho Ha, Kyungki-do, all of Rep. of Korea

[73] Assignee: Samsung Electronics Co., Ltd., Rep. of Korea

[21] Appl. No.: 08/755,065

[22] Filed: Nov. 22, 1996

[30] Foreign Application Priority Data

Nov. 24, 1995 [KR] Rep. of Korea ..... 95-43470

[51] Int. Cl.[6] ..... B41J 2/165

[52] U.S. Cl. ..... 347/23; 347/32

[58] Field of Search ..... 347/23, 32, 14, 347/5, 13, 37; 400/705, 705.1

[56] References Cited

U.S. PATENT DOCUMENTS 5,341,163 8/1994 Hanabusa ..... 347/23

5,627,570 5/1997 Hiramatsu et al. ..... 347/19

*Primary Examiner*—N. Le
*Assistant Examiner*—Thien Tran
*Attorney, Agent, or Firm*—Banner & Witcoff, Ltd.

[57] ABSTRACT

An apparatus for determining an initial position and protecting a capping release error in an inkjet printer head which can constitute a sensor for determining a printing initial position and a device for preventing a capping state from being released during the head is at a homestation, with a single sensor and two actuators. The apparatus includes a home sensor arranged in a frame, for sensing the initial position and the capping release error of a carriage to transmit a sensing signal to a controller, a first actuator disposed in a right side of the carriage, for sensing an initial position of the carriage in which a head is mounted to perform a printing operation in a print interval, when power in the printer is turned on or a printing command is issued, and a second actuator disposed in a left side of the carriage and passing the home sensor, for maintaining a state where a cap is capped on a nozzle of the head after the carriage is moved to a service interval and for controlling a position of the carriage, to thereby prevent a capping state from being released.

2 Claims, 5 Drawing Sheets

FIG. 3
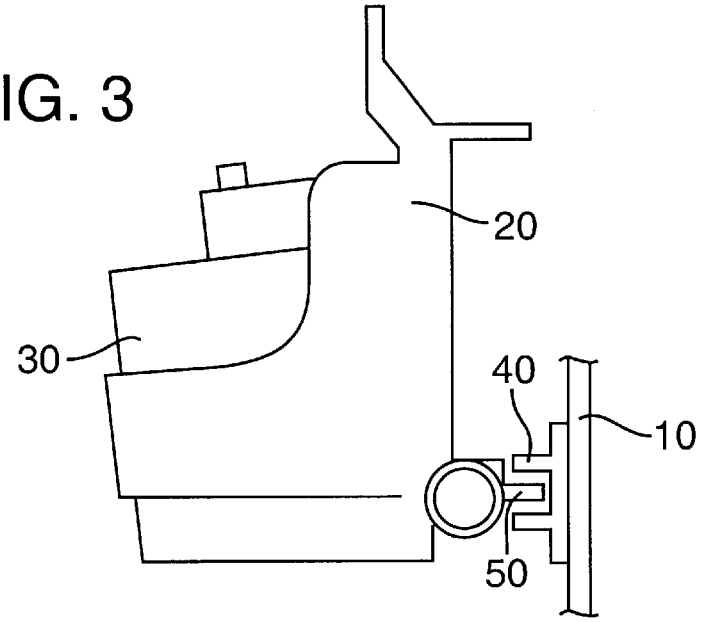
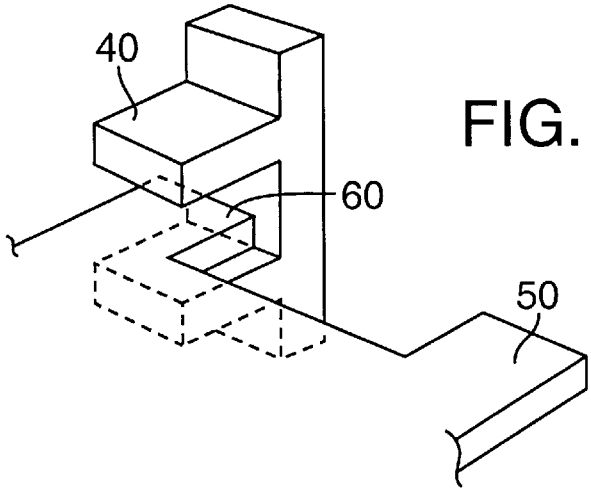
FIG. 4(A)
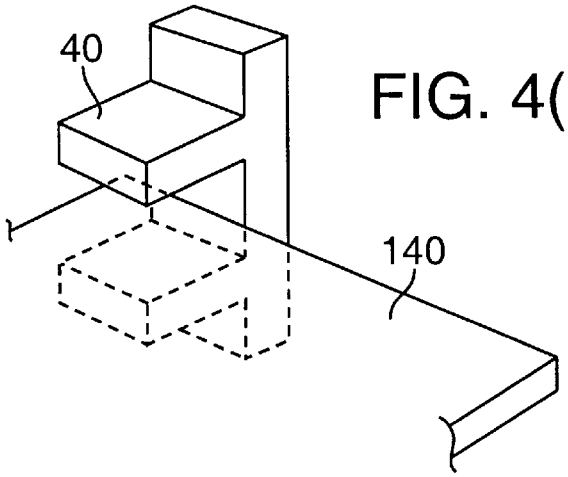
FIG. 4(B)

APPARATUS AND METHOD FOR DETERMINING INITIAL POSITION AND PROTECTING CAPPING RELEASE ERROR IN INKJET PRINTER HEAD

BACKGROUND OF THE INVENTION

1. Field of the Invention

The present invention relates to an inkjet printer head, and more particularly to an apparatus and method for determining an initial position and protecting a capping release error in an inkjet printer head which can constitute a sensor for determining a printing initial position and a device for preventing a capping state from being released during the head is at a homestation, with a single sensor and two actuators.

2. Description of the Related Art

Generally, a printing machine, which performs a printing operation by mounting a head on a carriage, has adopt various methods for recognizing a current printing position of the head. As representative ones, there are a method for recognizing a reference position using an encoder and a method for memorizing a moving distance from a reference position by installing a home sensor at a predetermined position and thereby sensing a current position of the head.

The encoder utility method exhibits a problem in that a production cost is high because the encoder itself is expensive.

The home sensor installing method also exhibits a problem in that a production cost is high because a great number of stepping motors are used.

FIG. 1 is a schematic view showing a construction of a conventional initial position determining and capping release error protecting apparatus. In the construction, a home sensor 1 is mostly used with an optical sensor or microswitch, and a single actuator 2 is disposed at a carriage 3 and senses the home sensor 1 to thereby control a reference position.

Whenever the control for the reference position is executed during a printing operation, the home sensor 1 is adapted to be sensed to thereby avoid deviation of the reference position. So as to control the reference position during the printing operation, when the actuator 2 moves to the home sensor 1, the carriage 3 moves up to a servicestation 4, such that the carriage 3 becomes in contact with the components of servicestation 4, which results in generation of noises. Accordingly, the carriage 3 in the home sensor 1 position should set the reference position in such a manner that it is placed in left direction from a capping position.

The carriage 3 performs a round trip within a print interval, and the capping position moves toward a service interval by a distance determined on the basis of a mechanical design value after the home sensing is executed.

It is, however, difficult to prevent a capping release error with one home sensor 1 and one actuator 2, as shown in FIG. 1. Since a cap 5 made of a rubber material is structured to perform a capping operation within the interval (3 mm or more) where the cap 5 may be deviated during capping a nozzle 8, only one home sensor 1 and one actuator 2 have great difficulties in simultaneously sensing an initial position and a capping release error generation of the printer head.

Accordingly, a sensing device is needed for determining the initial position during the printing operation, and further a device for preventing a capping state from being released is required during the head 6 is at the servicestation 4. However, while the capping state is kept, if the head 6 is considerably moved toward the print interval due to an impact from the outside and unexpected external force and thus a capping release error is undesirably generated, it is impossible to return to the capping state, so that the nozzle 7 of the head 6 may be dried and will be finally blocked.

SUMMARY OF THE INVENTION

Accordingly, the present invention is directed to an apparatus and method for determining an initial position and protecting a capping release error in an inkjet printer head that substantially obviates one or more of the problems due to limitations and disadvantages of the related art.

An object of the invention is to provide an apparatus and method for determining an initial position and protecting a capping release error in an inkjet printer head which can constitute a sensor for determining a printing initial position and a device for preventing a capping state from being released during the head is at a homestation, with a single sensor and two actuators.

In accordance with an aspect of the present invention, an apparatus for determining an initial position and protecting a capping release error in an inkjet printer head includes: a home sensor disposed in a frame, for sensing the initial position and the capping release error of a carriage to transmit a sensing signal to a controller; a first actuator disposed in a right side of the carriage, for sensing the initial position of the carriage in which the bead is mounted to perform a printing operation in a print interval, when power in the printer is turned on or a printing command is issued; and a second actuator disposed in a left side of the carriage and passing the home sensor, for maintaining a state where a cap is capped on a nozzle of the head after the carriage is moved to a service interval and for controlling a position of the carriage, to thereby prevent a capping state from being released.

In accordance with another aspect of the present invention, an apparatus for determining an initial position and protecting a capping release error in an inkjet printer head includes: a controller for comparing various kinds of functions and controlling whole parts of the printer; a keyboard for inputting printing and capping signals to the controller; an external interface connected to the outside, for interfacing the outside with a communication port of the controller; a home sensor for sensing the initial position and a capping state of a carriage to transmit a sensing signal to the controller; a memory for memorizing input data to transmit the input data to the controller; a motor driver for comparing an input signal from the home sensor with the input data of the memory to drive a motor by a control of the controller; and a head driver for comparing the input signal from the home sensor with the input data of the memory to actuate a head by a control of the controller.

In accordance with yet another aspect of the present invention, a capping release error protecting method in an inkjet printer head includes the steps of: determining as to whether a position of a carriage is in a capping state after the carriage is stopped; checking as to whether a home sensor senses a second actuator, while the position of the carriage is in the capping state; if the home sensor fails to sense the second actuator due to a capping release error, waiting for about 20 to 30 seconds in consideration of the case where a user holds the carriage; when the position of the carriage is moved by an external impact or the user, compensating the position of the carriage with a moving distance and returning to a capping position; checking as to whether the head is in the carriage or the head is changed to a black or color head; and inputting a normal state of the printer to the controller, when the home sensor senses the second actuator or when the type of the head is checked and completing a capping release error protecting operation.

In accordance with still another aspect of the present invention, an initial position determining method in an inkjet printer head includes the steps of: determining as to whether the head mounted on a carriage performs a printing operation; if the head is on the printing operation, determining as to whether a performance requirement for checking a reference position is satisfied; if satisfied, moving a first actuator disposed in a right side of the carriage in a right direction to thereby sense a home sensor and setting the reference position; and controlling a position of the carriage using the set reference position, to thereby determine the initial position of the carriage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 3 is a side view showing main parts of FIG. 2;

FIGS. 4A and 4B are views showing preferred embodiments of an initial position determining and capping release error protecting apparatus according to the present invention;

DETAILED DESCRIPTION OF THE PREFERRED EMBODIMENT

Figure 1:
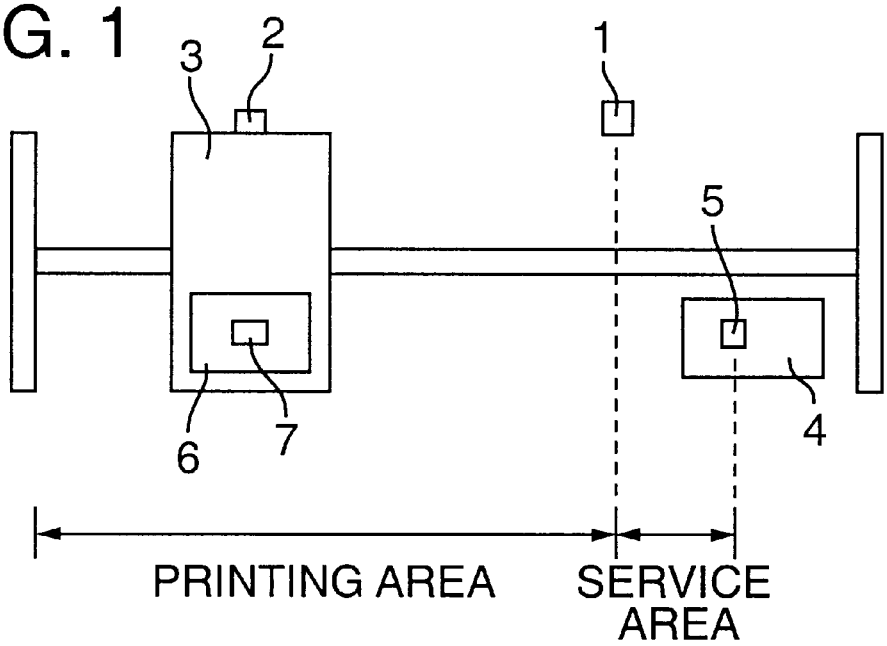
FIG. 1 is a schematic view showing a construction of a conventional initial position determining and capping release error protecting apparatus.
Figure 2:
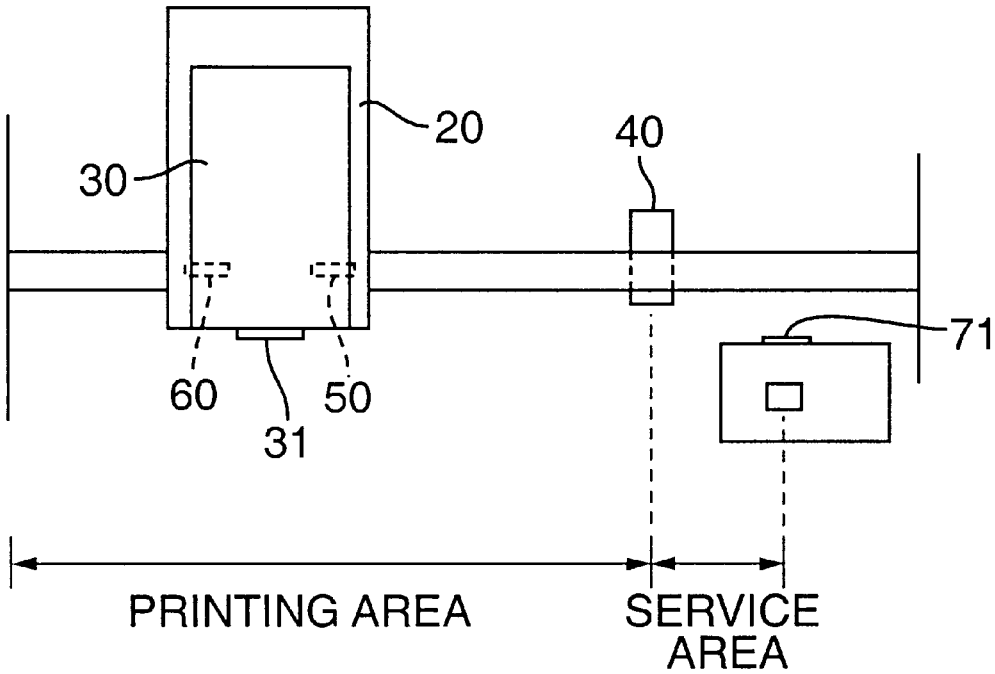
FIG. 2 is a schematic view showing a construction of an initial position determining and capping release error protecting apparatus according to the present invention.

Reference will now be made in detail to the preferred embodiments of the present invention, examples of which are illustrated in the accompanying drawings.

Referring to FIGS. 2 to 5, an explanation of a construction of an initial position determining and capping release error protecting apparatus in an inkjet printer according to the present invention will be discussed. In the construction, there are provided a home sensor 40 arranged in a frame 10, for sensing an initial position and a capping release error of a carriage 20 to transmit a sensing signal to a controller 80; a first actuator 50 disposed in a right side of the carriage 20, for sensing an initial position of the carriage 20 in which a head 30 is mounted to perform a printing operation in a print interval, when power in the printer is turned on or a printing command is issued; and a second actuator 60 disposed in a left side of the carriage 20 and passing the home sensor 40, for maintaining a state where a cap 71 is capped on a nozzle 31 of the head 30 after the carriage 20 is moved to a service interval and for controlling a position of the carriage 20, to thereby prevent a capping state from being released.

Referring to FIG. 4A, the sensing operation of the home sensor 40 is accomplished when both the first and second actuators 50 and 60 reach the home sensor 40.

Referring to FIG. 4B, however, the first and second actuators 50 and 60 are connected to each other to form a single actuator 140, so that when both ends of the actuator 140 pass the home sensor 40, the home sensor 40 can sense the initial position. In this case, the controller 80 is programmed in such a manner that the sensing operation of the home sensor 40 can be accomplished, only when both ends of the actuator 140 all deviate the home sensor 40.

Figure 5:
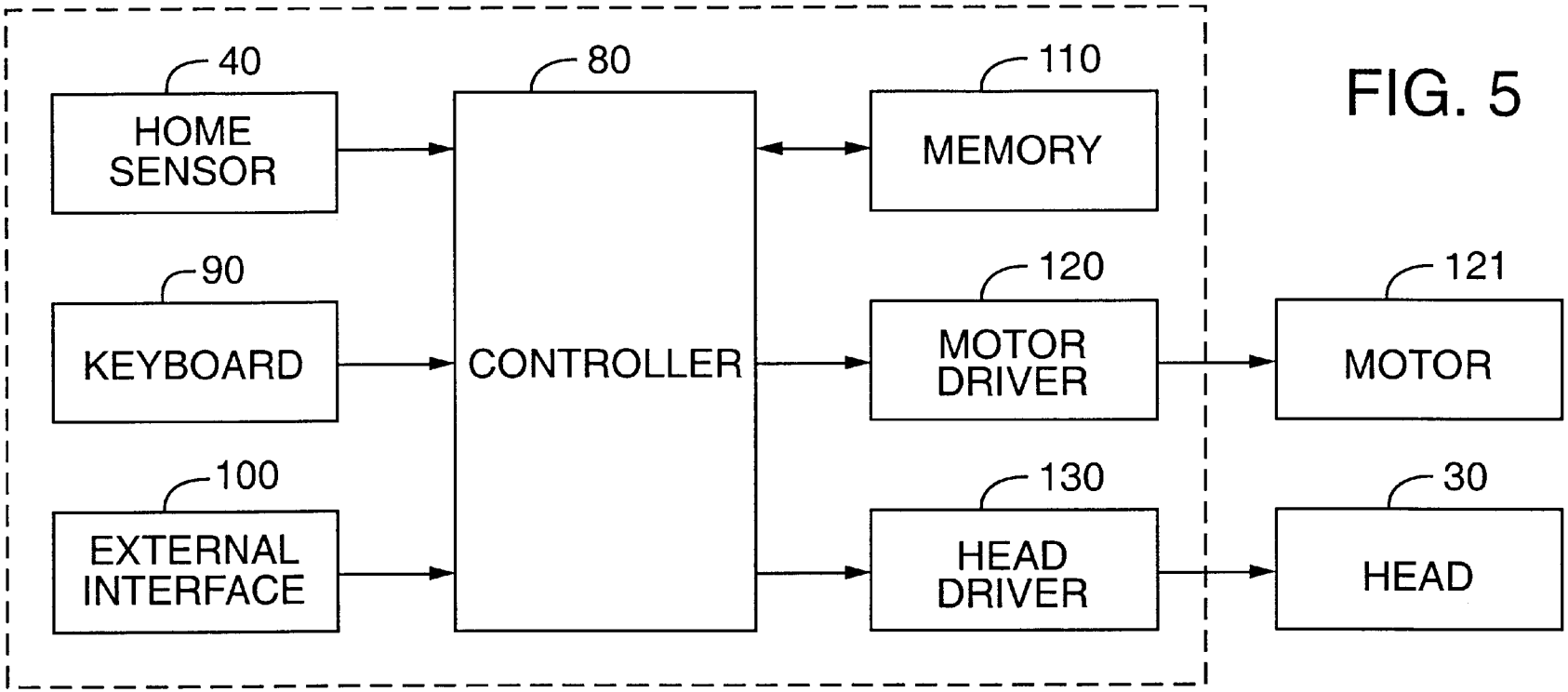
FIG. 5 is a block diagram showing a hardware construction of an initial position determining and capping release error protecting apparatus according to the present invention.

Referring to FIG. 5, a block diagram showing a hardware construction of an initial position determining and capping release error protecting apparatus in an inkjet printer head according to the present invention is shown. In the construction, there are provided a controller 80 for comparing various kinds of functions and controlling whole parts of the printer; a keyboard 90 for inputting printing and capping signals to the controller 80; an external interface 100 connected to the outside, for interfacing the outside with a communication port of the controller 80; a home sensor 40 for sensing the initial position and a capping state of a carriage 20 to transmit a sensing signal to the controller 80; a memory 110 for memorizing input data to transmit the input data to the controller 80; a motor driver 120 for comparing an input signal from the home sensor 40 with the input data of the memory 110 to drive a motor 121 by a control of the controller 80; and a head driver 130 for comparing the input signal from the home sensor 40 with the input data of the memory 110 to actuate the head 30 by a control of the controller 80.

Figure 6:
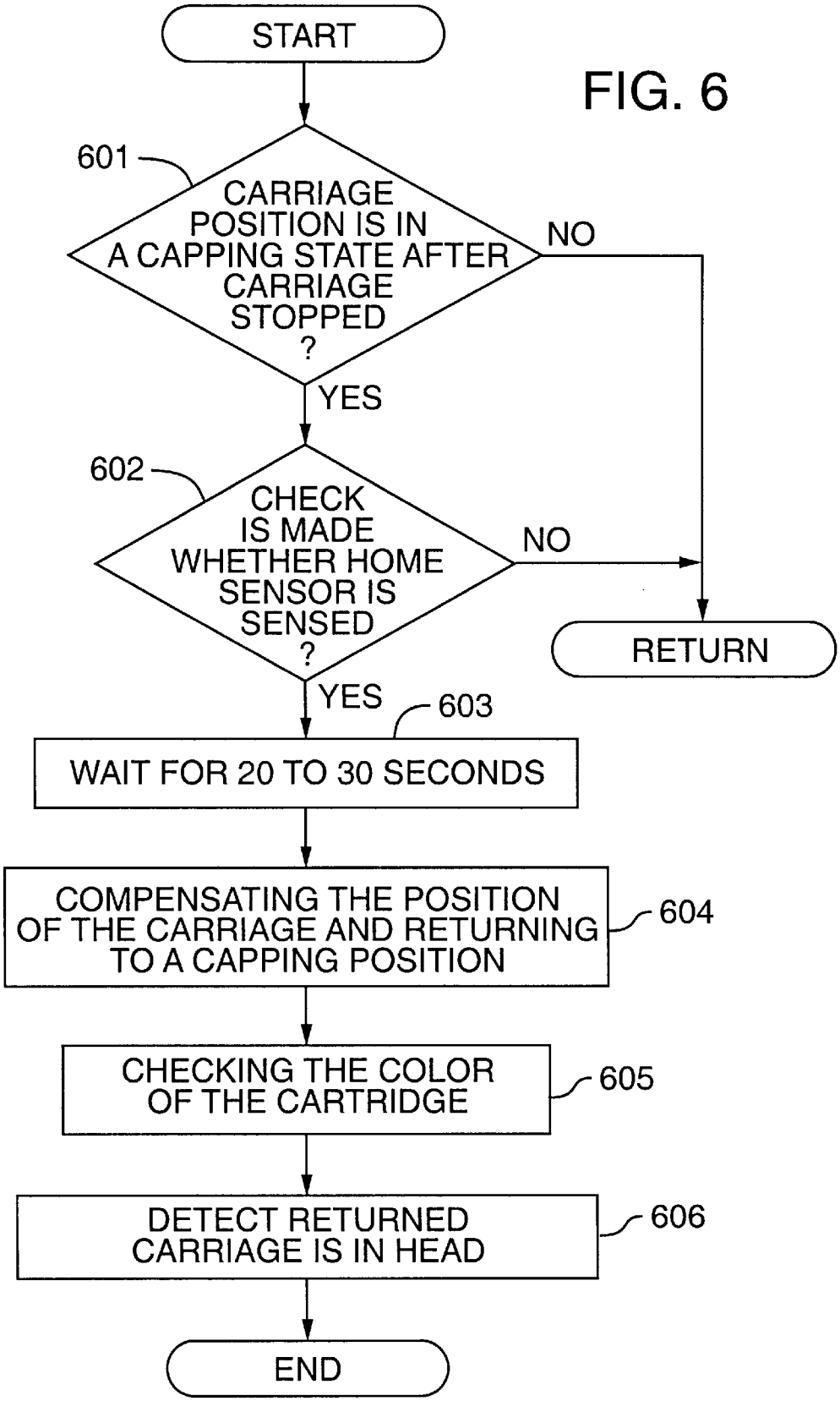
FIG. 6 is a flowchart showing a capping release error protecting method according to the present invention.

Referring to FIG. 6, a capping release error protecting method in an inkjet printer head includes the steps of: determining as to whether a position of a carriage is in a capping state after the carriage is stopped; checking as to whether a home sensor senses a second actuator while the position of the carriage is in the capping state; if the home sensor fails to sense the second actuator due to a capping release error, waiting for about 20 to 30 seconds in consideration of the case where a user holds the carriage; when the position of the carriage is moved by an external impact or the user, compensating the position of the carriage with a moving distance and returning to a capping position; checking as to whether the head is in the carriage or the head is changed to a black or color head; and inputting a normal state of a printer to the controller, when the home sensor senses the second actuator or the type of the head is checked and completing a capping release error protecting operation.

Figure 7:
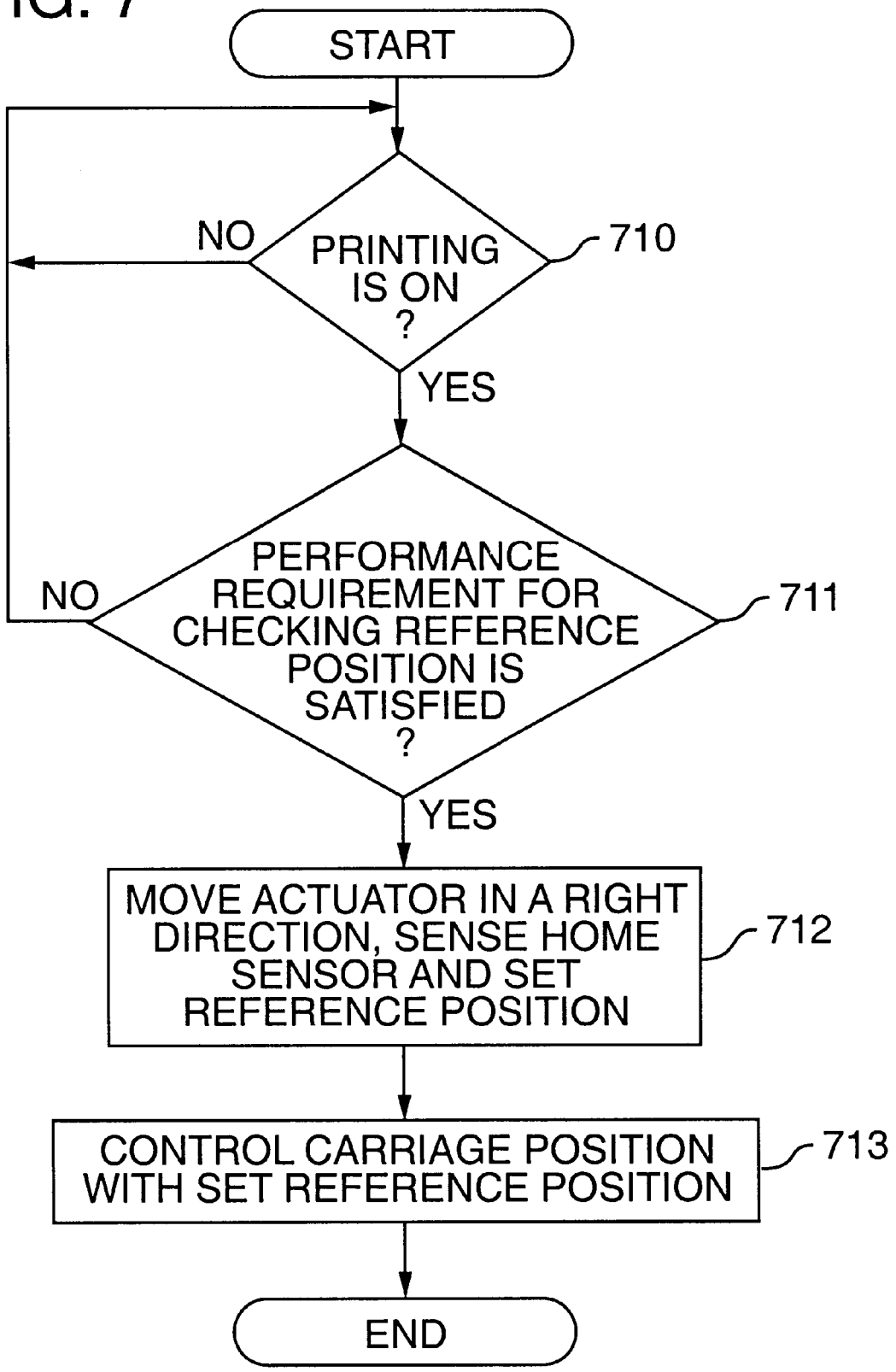
FIG. 7 is a flowchart showing an initial position determining method according to the present invention.

Referring to FIG. 7, an initial position determining method in an inkjet printer head includes the steps of: determining as to whether the head mounted on a carriage performs a printing operation; if the head is on the printing operation, determining as to whether a performance requirement for checking a reference position is satisfied; if satisfied, moving a first actuator disposed in a right side of the carriage in a right direction to thereby sense a home sensor and setting the reference position; and controlling a position of the carriage using the set reference position, to thereby determine the initial position of the carriage.

An explanation of the operation of an initial position determining and capping release error protecting apparatus in an inkjet printer head according to the present invention will be given with reference to FIGS. 2 to 5.

When power the printer is turned on or a printing command is issued, the carriage 20 in which the head 30 is mounted moves in the right direction towards the home sensor 40, and at the time, the first actuator 50 positioned in the right side reaches the home sensor 40, to thereby set the reference position. The position of the carriage 20 is controlled using the reference position.

Namely, a printing signal from the controller 80 is continuously outputted to the motor driver 120 and the head driver 130 to perform a printing operation, and during the printing operation, when the first actuator 50 reaches the home sensor 40, the controller 80 sets an initial position to allow next line to be printed.

For the capping of the nozzle 31, the controller 80 transmits a control signal to the motor driver 120, so that the carriage 20 moves to the service interval. At the time, when the first actuator 50 passes the home sensor 40 and thus the second actuator 60 is placed at the home sensor 40, the nozzle 31 of the head 30 is capped by the cap 71 to thereby maintain a sealing state.

However, if the carriage 20 moves to the print an error such as to external impacts or forces, the nozzle 31 of the head 30 is deviated from the cap 71, and simultaneously the second actuator 60 disposed integrated with the carriage 20 becomes deviated from the home sensor 40, so that a capping release error occurs.

As a result, since the home sensor 40 can not sense the second actuator 60, the controller 80 receives a signal of the home sensor 40 to drive the motor driver 120 and thus the carriage 20 returns to the service interval.

Although the controller 80 is programmed in such a manner that the carriage 20 is placed in the service interval so as to maintain the nozzle 31 of the head 30 in a capping state, since the position of the second actuator 60 is simultaneously changed at the time when the position of carriage 20 is altered due to the external impacts or forces, the controller 80 receives the signal of home sensor 40 and compensates the position of carriage 20 with the changed distance to maintain the capping state.

Referring to FIG. 4B showing another embodiment of the present invention, the first and second actuators 50 and 60 are connected to each other to form the single actuator 140, so that when both ends of the actuator 140 pass the home sensor 40, the home sensor 40 can sense the initial position.

Accordingly, it can be understood that one home sensor 40 and two actuators 50 and 60 can simultaneously sense an initial position upon printing as well as a capping release error generated upon capping, so that a problem that an ink is dried can be solved to improve a quality of printing image and a production cost can be lowered owing to a simple system construction.

As shown FIG. 6, an operation procedure of the capping release error protecting method in an inkjet printer head will be hereinafter described. First, when a capping starting button is entered, at step 601, the carriage 20 is stopped and a determination is made as to whether a position of the carriage 20 is in a capping state. At step 602, while the position of the carriage 20 is in the capping state, a detection is made as to whether the home sensor 40 senses the second actuator 60. If the home sensor 40 fails to sense the second actuator 60 due to a capping release error, a waiting operation is at step 603 performed for about 20 to 30 seconds in consideration of the case where a user holds the carriage 20. At step 604, when the position of the carriage 20 is moved by an external impact or the user, the position of the carriage 20 is compensated with a moving distance and the carriage 20 returns to a capping position.

Next, at step 605, a detection is made as to whether the head 30 is in the returned carriage 20 or the head 30 is changed to a black or color head. At step 606, the home sensor 40 senses the second actuator 60 or the type of the head 30 is checked and a normal state of the printer is inputted to the controller, thereby completing a capping release error protecting operation.

As shown FIG. 7, an operation procedure of the initial position determining method in an inkjet printer head will be hereinafter described. At step 710, a determination is made as to whether the head 30 mounted on the carriage 20 performs a printing operation. Then, at step 711, if the head 30 is on the printing operation, a determination is made as to whether a performance requirement for checking a reference position is satisfied. If satisfied, at step 712, movement of the first actuator 50 disposed in a right side of the carriage 20 in a right direction is made to thereby sense the borne sensor 40 and the reference position is set. If not satisfied, however, it returns to the step 710. At step 713, next, the position of the carriage 20 is controlled using the set reference position, to thereby determine an initial position of the carriage 20.

As apparently discussed in the above, the present invention provides an apparatus and method for determining an initial position and protecting a capping release error in an inkjet printer head which can constitute a sensor for determining a printing initial position and a device for preventing a capping state from being released during the head is at a homestation, with a single sensor and two actuators. Therefore, one home sensor and two actuators can simultaneously sense an initial position upon printing as well as a capping release error upon capping, so that a problem that an ink is dried can be solved to improve a quality of printing image and a production cost can be lowered owing to a simple system construction.

It will be apparent to those skilled in the art that various modifications and variations can be made in an apparatus and method for determining an initial position and protecting a capping release error in an inkjet printer head of the present invention without departing from the spirit or scope of the invention. Thus, it is intended that the present invention cover the modifications and variations of this invention provided they come within the scope of the appended claims and their equivalents.

What is claimed is:

1. An apparatus for determining an initial position and protecting a capping release error in an inkjet printer head, said apparatus comprising:

a home sensor arranged in a frame, for sensing the initial position and the capping release error of a carriage to transmit a sensing signal to a controller;

a first actuator disposed on one side of said carriage, for sensing the initial position of said carriage in which the head is mounted to perform a printing operation in a print interval; and a second actuator disposed on an opposite side of said carriage and passing said home sensor, for maintaining a state where a cap is capped on a nozzle of said head after said carriage is moved to a service interval and for controlling a position of said carriage, to thereby prevent a capping state from being released.

2. The apparatus as claimed in claim 1, wherein said first actuator and second actuator are connected to each other to form a single actuator, so that when both ends of said single actuator pass said home sensor, said home sensor sensing the initial position.

* * * * *